United States Patent [19]

Brandt

[11] 3,984,165

[45] Oct. 5, 1976

[54] ELECTRICAL CONNECTOR PLUG AND GROUNDING ATTACHMENT (CONVERT-A-CORD)

[75] Inventor: Nina P. Brandt, Corte Madera, Calif.

[73] Assignee: The Raymond Lee Organization, Inc., New York, N.Y. ; a part interest

[22] Filed: June 16, 1975

[21] Appl. No.: 587,302

[52] U.S. Cl. ..... 339/14 P; 339/186 R

[51] Int. Cl.[2] ..... H01R 3/06

[58] Field of Search ..... 339/14 R, 14 L, 14 P, 339/14 T, 186 R, 188 R

[56] References Cited

UNITED STATES PATENTS 3,685,000 8/1972 Robbins ..... 339/14 P

*Primary Examiner*—Roy Lake
*Assistant Examiner*—DeWalden W. Jones
*Attorney, Agent, or Firm*—Howard I. Podell

[57] ABSTRACT

An electrical connector plug fitted with a flexible insulated wire ground lead that terminates in a prong of a size to fit the female grounding socket outlet. A separate attachable flexible wire is fitted at one end with a hollow tube of a size to fit over the prong of the plug ground lead, and is fitted at the other end with a connector shaped to fit about a grounding screw of a female outlet.

2 Claims, 3 Drawing Figures

FIG.1
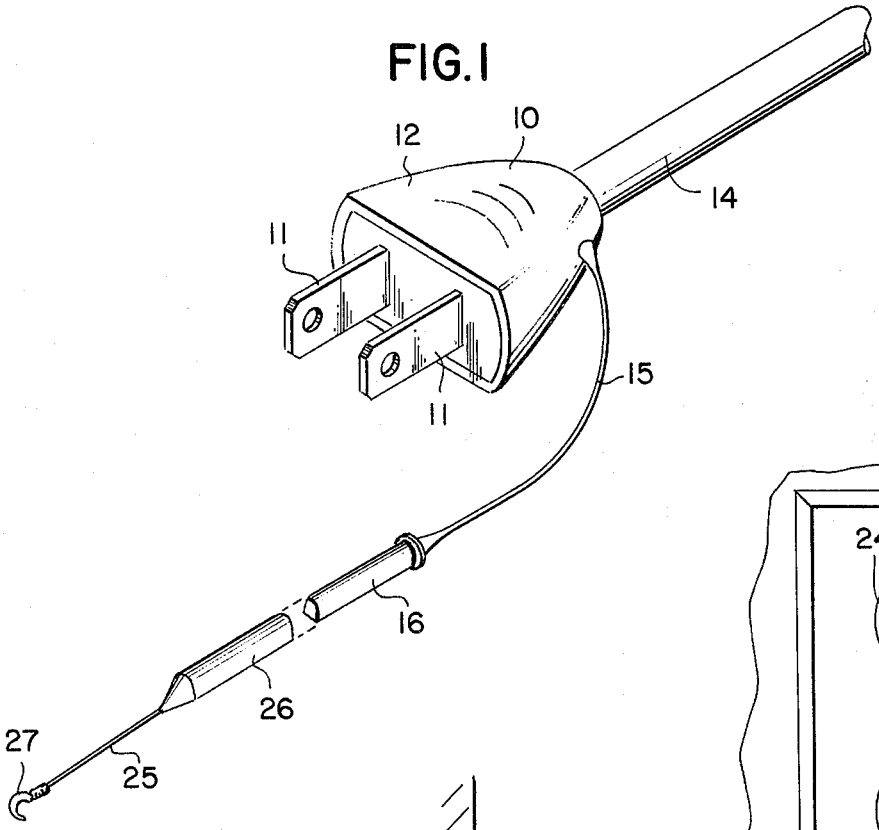
FIG.3
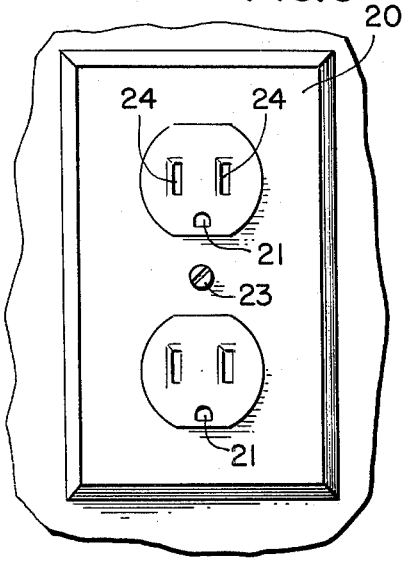
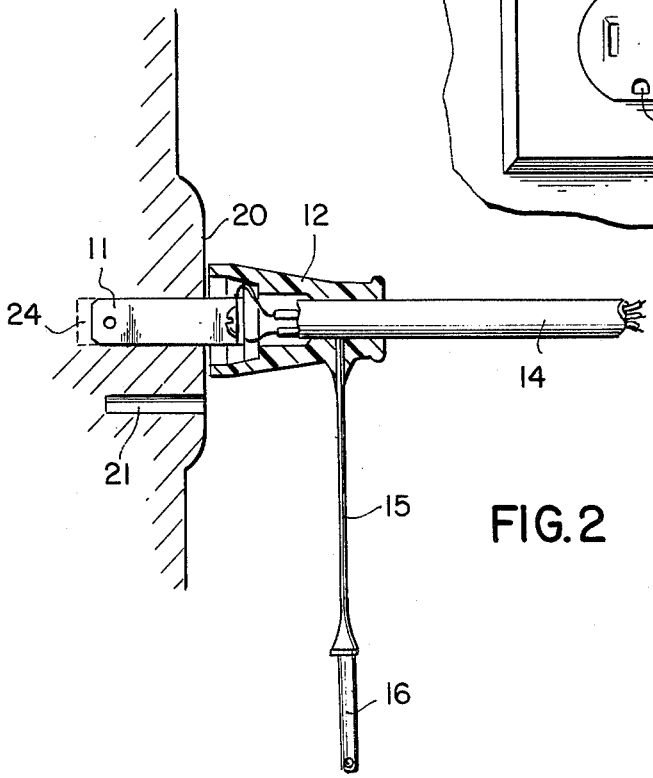
FIG.2

ELECTRICAL CONNECTOR PLUG AND GROUNDING ATTACHMENT (CONVERT-A-CORD)

SUMMARY OF THE INVENTION

My invention is an electrical connector plug fitted with a flexible insulated wire ground lead that terminates in a prong of a size to fit the female grounding socket outlet. A separate attachable flexible wire is fitted at one end with a hollow tube of a size to fit over the prong of the plug ground lead, and is fitted at the other end with a connector shaped to fit about a grounding screw of a female outlet.

The connector plug may be employed both with female outlets that are fitted with two and with three prong receptacles.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective exploded view of the electrical plug and attachment lead of the invention;

FIG. 2 is a side view of the plug inserted in a female outlet; and

FIG. 3 is a plan view of a female outlet fitted to receive conventional three prong plugs.

DESCRIPTION OF THE PREFERRED EMBODIMENT

Turning now descriptively to the drawings, in which similar reference characters denote similar elements throughout the several views, FIG. 1 illustrates the male plug 10 of the invention which is fitted with two fixed prongs 11, embedded in an insulated body 12, that are each connected to an individual conductor in the flexible insulated cable 14 fixed to the plug. An insulated flexible wire 15, which is connected in the body 12 to a groundwire of the cable 14, is led out of the plug body 12 to terminate in a metal socket pin 16 of a size and shape to fit into the ground receptacle 21 of a female electrical outlet 20.

An attachable flexible wire 25 is fitted at one end with a hollow metal tube 26 of a size to fit over socket pin 16, and at the other end in a wire connector 27 of a size to fit under the head of a face screw 23 on the female outlet 20.

In use, the two prongs 11 of plug body 12 may be engaged into the mating two conductor receptacles 24 of a female outlet 20 fitted with a ground pin receptacle 21, or alternately the two prongs 11 of plug body 12 may be engaged into the mating two conductor receptacles of a female outlet that is not fitted with a ground pin receptacle.

When plug 20 is employed with an outlet 20 fitted with a ground pin receptacle 21, prong 16 of flexible wire 15 of the plug is inserted into receptacle 21 to complete the grounding circuit. Where no pin receptacle 21 is provided in the female outlet, tube 26 is fitted over prong 16 and the wire connector 27 is fastened under the head of a screw 23 on the face plate of the female outlet.

It is to be noted that plug body 12 is shaped, as shown in FIG. 2 to clear the opening of the ground receptacle 21 of outlet 20 so as to permit prong 16 to be inserted into, or removed from receptacle 21 when prongs 11 of the plug body are engaged in the conductor receptacles 24 of the outlet 20.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A male electrical plug fitted with a fixed pair of spaced prongs adaptable to detachably engage an electrical female outlet fitted with mating sockets so as to make individual electrical contact between each fixed prong of the plug and a socket of the said outlet, said plug also fitted with a flexible ground wire leading from the said plug, which ground wire is fitted with a terminal pin adaptable for detachable fastening to a ground socket located on said outlet or alternately the terminal pin of said ground wire is adaptable for detachable fastening to a flexible attachment wire that may be fastened to any ground screw connected to a second outlet that is not fitted with a ground socket to which the plug is joined, comprising an electrical male plug formed of an insulated body which is fitted with a pair of spaced fixed prongs that extend from said body, each of which prongs is adaptable for individual connection in the plug to an individual conductor in a flexible insulated cable that may be attached to said plug, said prongs shaped to each fit into one of the two mating conductor sockets of a two conductor female outlet, said plug fitted with a flexible ground wire that extends from the said plug, said flexible wire being adaptable for connection in the plug to a ground wire in said flexible cable, said flexible ground wire externally terminating in a metal ground pin, adaptable for detachable mating with the ground socket of a first female outlet that is fitted with a female ground socket, together with a flexible attachment wire, one end of which is fitted with a female ground socket adaptable for detachable mating with the ground pin of the said flexible wire of the plug, and the other end of which is fitted with a wire connector adaptable for attachment to any ground screw connected to a second female outlet when the two prongs of the plug are engaged with the mating conductor sockets of the said second female outlet, said second female outlet not being equipped with a ground socket.

2. The plug as recited in claim 1 joined to a flexible multi-conductor cable that incorporates a ground wire, with each of two conductors of the cable individually joined in the plug to one of the two prongs of the plug and with the ground wire of the cable connected in the plug to the flexible ground wire.

* * * * *